US006186928B1

(12) United States Patent
Chen

(10) Patent No.: US 6,186,928 B1
(45) **Date of Patent: *Feb. 13, 2001**

(54) DUMBELL ADJUSTABLE IN WEIGHT

(76) Inventor: James Chen, No. 35, Tun Hi Rd., Chin Chan Li, Sa Lu, Taichung (TW)

( * ) Notice: Under 35 U.S.C. 154(b), the term of this patent shall be extended for 0 days.

This patent is subject to a terminal disclaimer.

(21) Appl. No.: 09/272,049

(22) Filed: Mar. 19, 1999

(51) Int. Cl.[7] ..... A63B 21/075
(52) U.S. Cl. ..... 482/107; 482/98; 482/108
(58) Field of Search ..... 482/93, 97, 98, 482/106, 107, 108, 908

(56) References Cited

U.S. PATENT DOCUMENTS

| | | | | |
|---|---|---|---|---|
| D. 359,778 | * | 6/1995 | Towley, III et al. | D21/682 |
| D. 422,654 | * | 4/2000 | Chen | D21/681 |
| 4,529,198 | * | 7/1985 | Hettick, Jr. | 482/107 |
| 5,637,064 | * | 6/1997 | Olson et al. | 482/108 |
| 5,769,762 | * | 6/1998 | Towley, III et al. | 482/108 |
| 5,779,604 | * | 7/1998 | Towley, III et al. | 482/108 |
| 5,971,899 | * | 10/1999 | Towley, III et al. | 482/108 |
| 6,033,350 | * | 3/2000 | Krull | 482/108 |
| 6,039,678 | * | 3/2000 | Dawson | 482/108 |
| 6,083,144 | * | 7/2000 | Towley, III et al. | 482/108 |
| 6,099,442 | * | 8/2000 | Krull | 482/108 |

* cited by examiner

*Primary Examiner*—John Mulcahy
*Assistant Examiner*—Victor K. Hwang
(74) *Attorney, Agent, or Firm*—Browdy and Neimark

(57) ABSTRACT

A dumbbell is made up of a carrying seat, a plurality of weights, and a weight-selecting device. The carrying seat is formed of two plates, two hollow rods and a grip. The plates are provided with a plurality of through holes and carrying grooves. One of the two plates is provided with a receiving cell. The weights are formed of two identical block bodies each having two through holes and a plurality of carrying grooves. The two block bodies are provided with two connection rods fastened therebetween to facilitate the juxtaposing of the weights on the carrying seat. The weight-selecting device is disposed in the receiving cell and is composed of an adjustor, and two pins which are disposed in the hollow rods such that the pins are connected at one end thereof with the adjustor, and that the pins are corresponding at other end thereof to one of the through holes of the plates, and further that the two pins can be extracted from or retracted into the hollow rods. The carrying seat can be thus coupled with a desired number of weights.

9 Claims, 6 Drawing Sheets

DUMBELL ADJUSTABLE IN WEIGHT

FIELD OF THE INVENTION

The present invention relates generally to an exercise device, and more particularly to an adjustable dumbbell.

BACKGROUND OF THE INVENTION

The conventional dumbbell of the most primitive type is made integrally of a metal material by casting and is therefore provided with a fixed weight. The conventional dumbbell of the more advanced type is provided with a plurality of round weights joined by a short bar by which it is lifted or swung about in the hand for muscular exercise. Such a dumbbell is therefore adjustable in weight. The round weights of the dumbbell are movable and can therefore accidentally fall on the ground to inflict a wound on the dumbbell user or bystanders.

With a view to overcoming the drawbacks of the conventional dumbbells described above, a prior art dumbbell is provided with a plurality of rectangular weights. The number of weights that can be lifted along with the dumbbell main body can be manipulated by changing the position of a fastening pin in a groove. In light of the fastening pin being located insecurely in the groove, the weights can accidentally fall on the ground at the time when the dumbbell is in use. In addition, after a prolonged use of the dumbbell, the fastening pin is vulnerable to deformation, thereby causing the fastening pin to be unable to press securely against the connection rod of the weights.

SUMMARY OF THE INVENTION

It is therefore the primary objective of the present invention to provide a dumbbell which is adjustable in weight and is free from the drawbacks of the conventional dumbbells described above.

In keeping with the principle of the present invention, the foregoing objective of the present invention is attained by a dumbbell which is made up of a carrying seat, a plurality of weights, and a selection device. The carrying seat is formed of two parallel plates, two hollow rods, and a grip. Each of the two parallel plates is provided with a plurality of through holes corresponding to the hollow rods, and a plurality of carrying grooves. One of the plates is provided at the top thereof with a receiving cell. Each of the weights has two identical block bodies each having two through holes corresponding to the through holes of the plates, and a plurality of carrying grooves. Two connection rods are disposed between the bottoms of the two block bodies and are different in length to facilitate the juxtaposing of the weights at the outer side of the carrying seat, thereby enabling each of the connection rods to press against a predetermined carrying groove. The selection device is disposed in the receiving cell and is composed of an adjustor, and two pins which are disposed in the two hollow rods such that the pins are connected at one end thereof with the adjustor, and that other end of the pins is corresponding in location to a predetermined through hole of the plates, and further that the two pins can be moved into or out of the hollow rods, thereby enabling the ends of the pins to extend into the through holes of the block bodies. The carrying seat is thus coupled with a desired number of the weights.

DETAILED DESCRIPTION OF THE INVENTION

Figure 1:
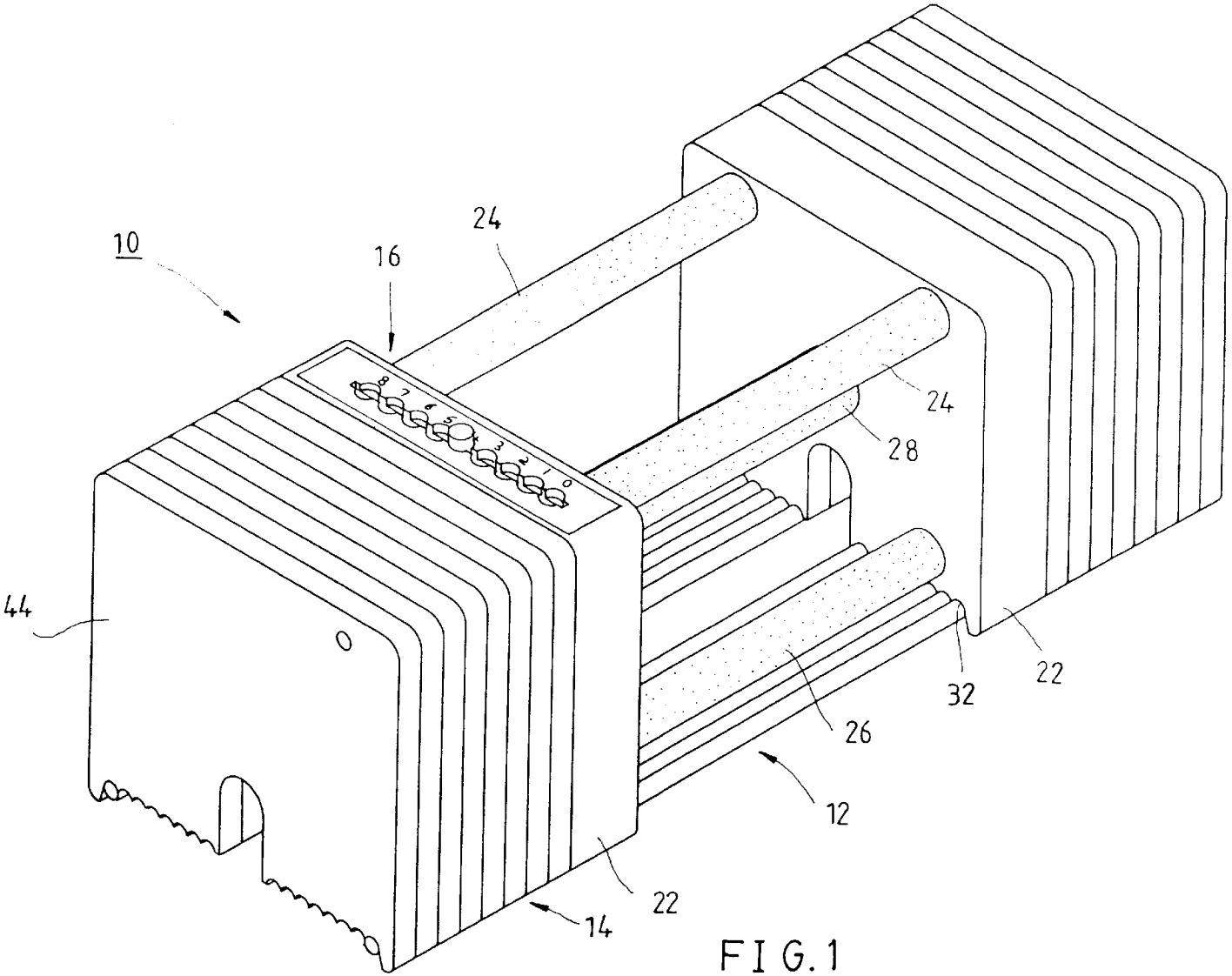
FIG. 1 shows a perspective view of a first preferred embodiment of the present invention.

As shown in FIGS. 1–4, a dumbbell 10 of the first preferred embodiment of the present invention is composed of a carrying seat 12, a plurality of weights 14, and a selection device 16.

The carrying seat 12 is formed of two plates 22, two hollow rods 24, two support rods 26, and a grip 28. Each plate 22 is provided with a through hole 30 corresponding in location to the hollow rod 24, and a plurality of carrying grooves 32 having an opening that faces downwards. One of the plates 22 is provided with a receiving cell 34 which is covered by a cover plate 36 which is in turn provided with a guide slot 38 extending along the direction of a longitudinal axis thereof, and eight carrying cavities 40 which are of a fisheye construction and are designated by the reference numerals of 1, 2, 3, 4, 5, 6, 7, and 8. The cavities 40 located at both ends are separated from the end edge of the guide slot 38 by a distance. The hollow rods 24, the support rods 26 and the grip 28 are provided respectively with a protective sleeve 42.

Each of the weights 14 has two metal block bodies 44 identical in shape to each other and having two through holes 46 located at both ends of the top thereof. The block bodies 44 are further provided in the bottom thereof with a plurality of carrying grooves 48 having an opening that faces downward. Connected between the bottoms of the two block bodies 44 are two connection rods 50 which are parallel to each other and are different in length between different pairs of black bodies. The weights 14 are thus juxtaposed such that the block bodies 44 are corresponding to one another, and that the connection rods 50 press against all carrying grooves 48. The plates 22 of the carrying seat 12 can be disposed between the block bodies 44 and the connection rods 50 which also press against all carrying grooves 32.

The selection device 16 is composed of an adjustor 52, two pins 54, two cords 56, a steering mechanism 58, and two elastic members 60. The adjustor 52 has a base 62 which is disposed in the receiving cell 30 such that the top of the base 62 is jutted out of the guide slot 38, and that the bottom of the base 62 are fastened with the two cords 56. The protruded end 66 of the base 62 is covered with a cap 64. A spring 68 is disposed between the protruded end 66 and the cap 64 for forcing the cap 64 to press against constantly a predetermined carrying cavity 40 at the time when the cap 64 is not exerted on by an external force. The pins 54 have a shank 70 and a head 72 greater in diameter than the shank 70. The two pins 54 are disposed in the two hollow rods 24 such that the free ends of the shanks 70 are received in the through holes 30 of the two plates 22. The other ends of the two cords 56 are fastened with the heads 72 of the pins 54 via the steering mechanism 58. The steering mechanism 58 has two rotary wheels 74. The elastic members (springs) 60 are fitted over the shanks 70 which are located in the hollow rods 24. The springs 60 are located between the heads 72 of the pins 54 and the plates 22 so as to keep the cords 56 in a fully-expanded state, thereby enabling the adjustor 52, two cords 56 and the pins 54 to remain in a linkage relationship.

Figure 2:
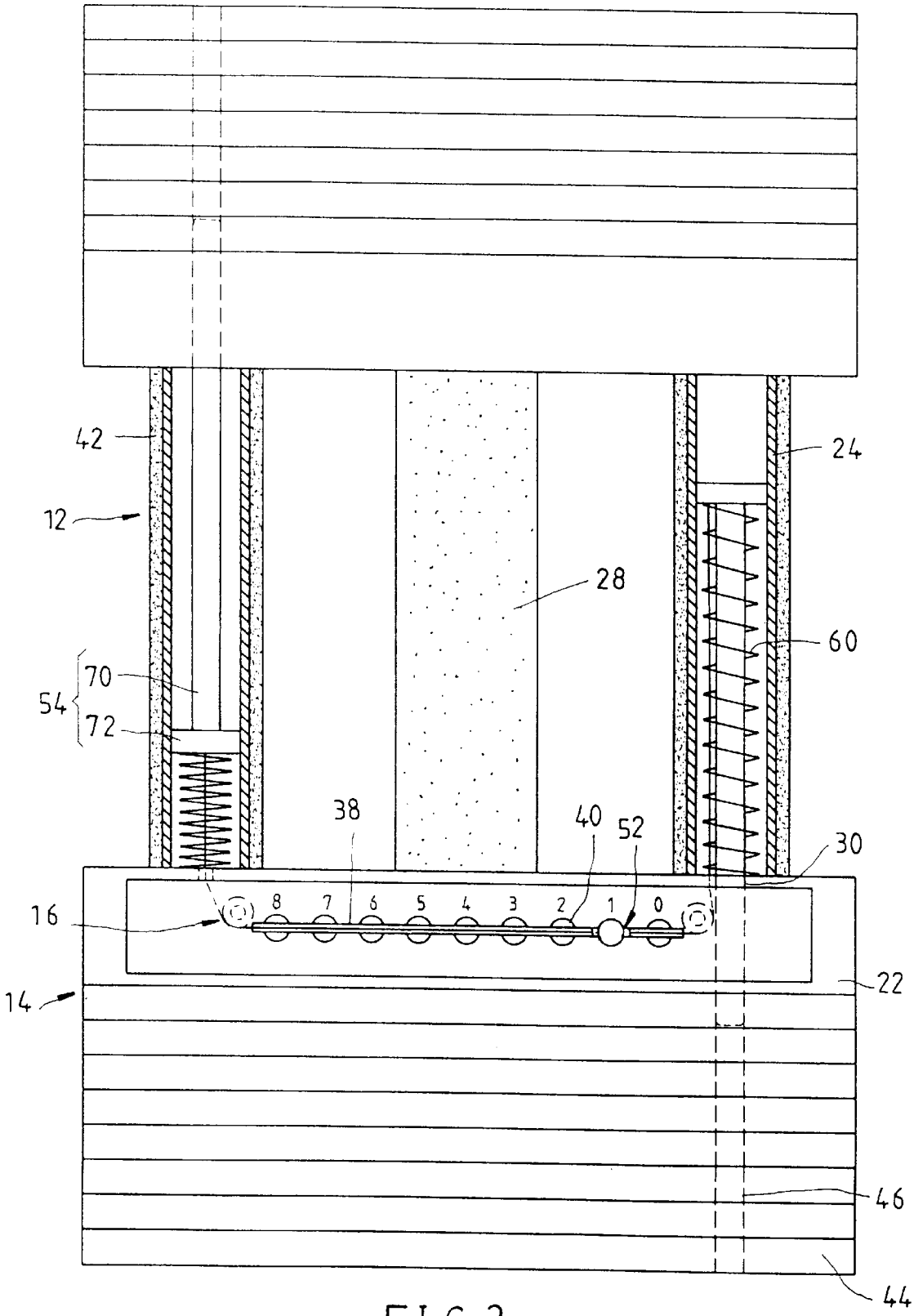
FIG. 2 shows a partial sectional view of the first preferred embodiment of the present invention.
Figure 3:
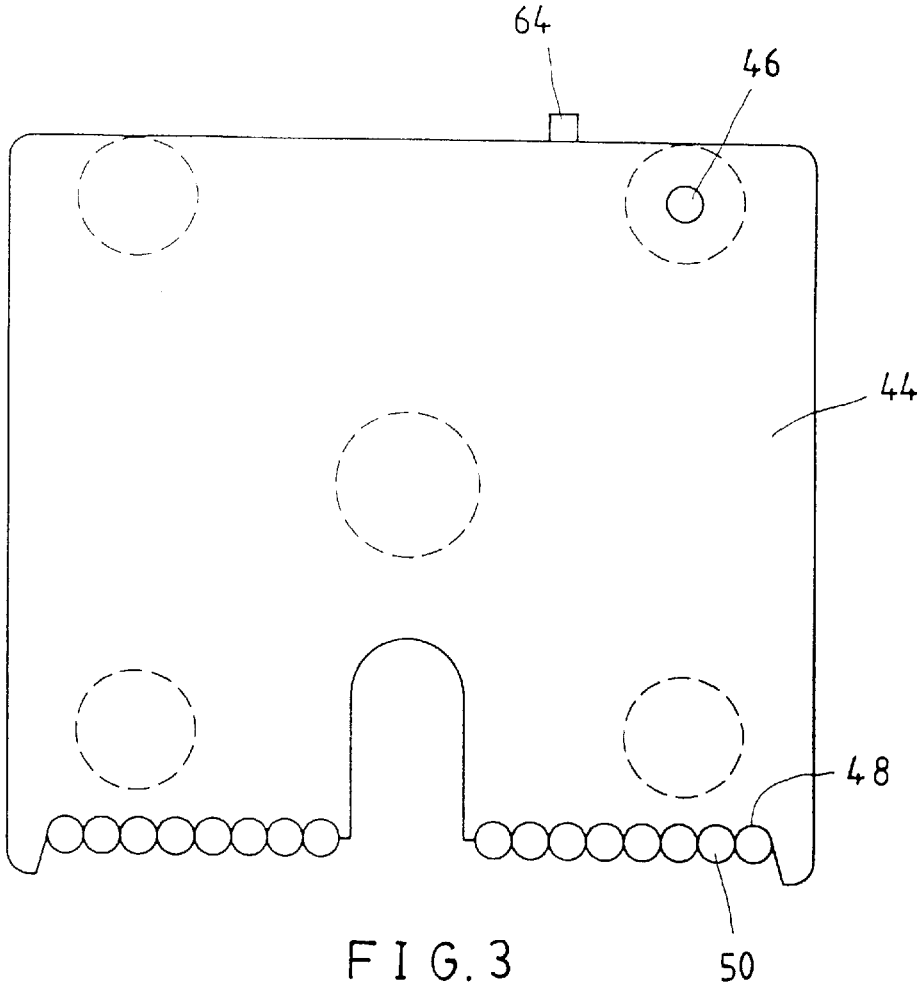
FIG. 3 shows a front view of the first preferred embodiment of the present invention.
Figure 4:
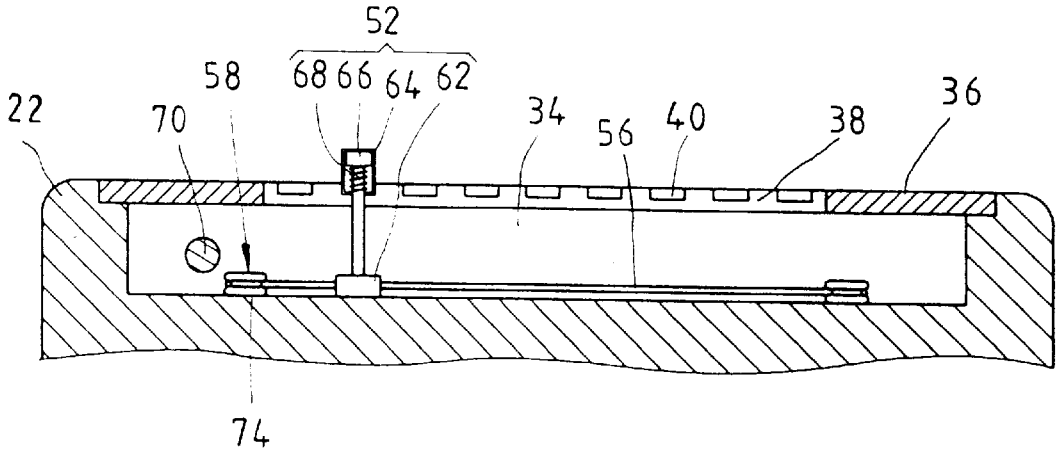
FIG. 4 shows a schematic view of the selection device of the first preferred embodiment of the present invention.
Figure 5:
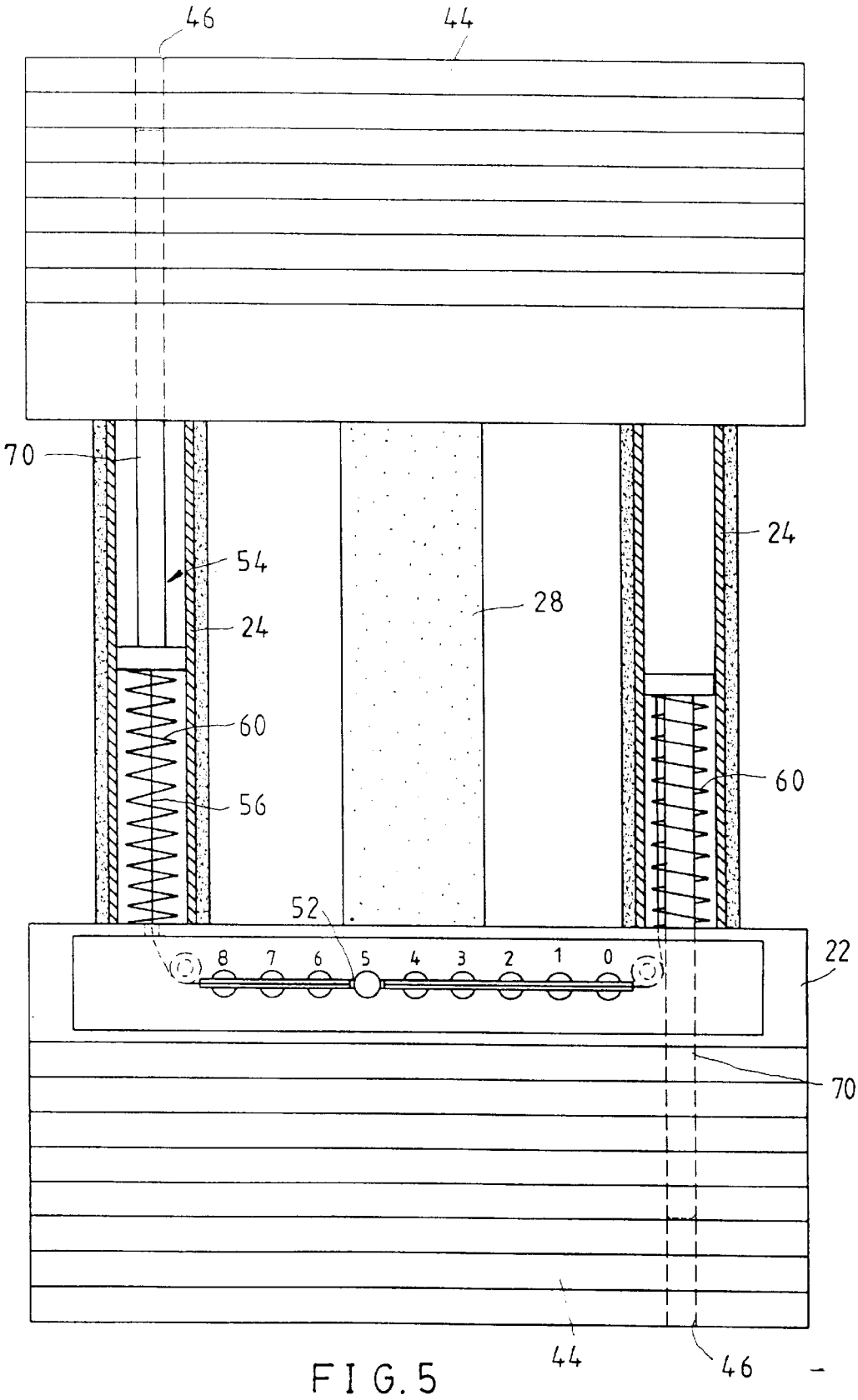
FIG. 5 shows a schematic view of the first preferred embodiment of the present invention in action.

As shown in FIG. 2, when the adjustor 52 is located at the carrying cavity 40 bearing the reference numeral "1". The free ends of the shanks 70 of the two pins 54 are jutted out of the plates 22 to reach into the through holes 46 of the block bodies 44 of a first weight 14. When the carrying seat 12 is lifted by the grip 28, one weight 14 is carried along. Now referring to FIG. 5, when the adjustor 52 is moved leftwards to locate at the carrying cavity 40 bearing the reference numeral "5", the cords 56 are loosened so that the spring 60 located at the left is decompressed. The pin 54 located at the left is therefore caused to push the plate 22 outwards for a distance. In the meantime, the pin 54 located at the right is pulled back by the cord 56 so that the pin 54 pushes another plate 22 outwards for a distance equal to the distance referred to above in connection with the plate 22. As a result, the shanks 70 of the two pins 54 are extended into the through holes 46 of the block bodies 44 of five weights 14. In the event that the exerciser desires to lift more weights 14 in excess of five, the adjustor 52 is moved leftwards to locate at the carrying cavity 40 bearing the reference numeral of 6 or higher. On the other hand, as the adjustor 52 is moved rightwards to locate at a carrying cavity 40 bearing a lower reference numeral, fewer weights 14 are carried by the dumbbell 10 by virtue of the fact that the two pins 54 are retracted into the hollow rods 24.

Figure 6:
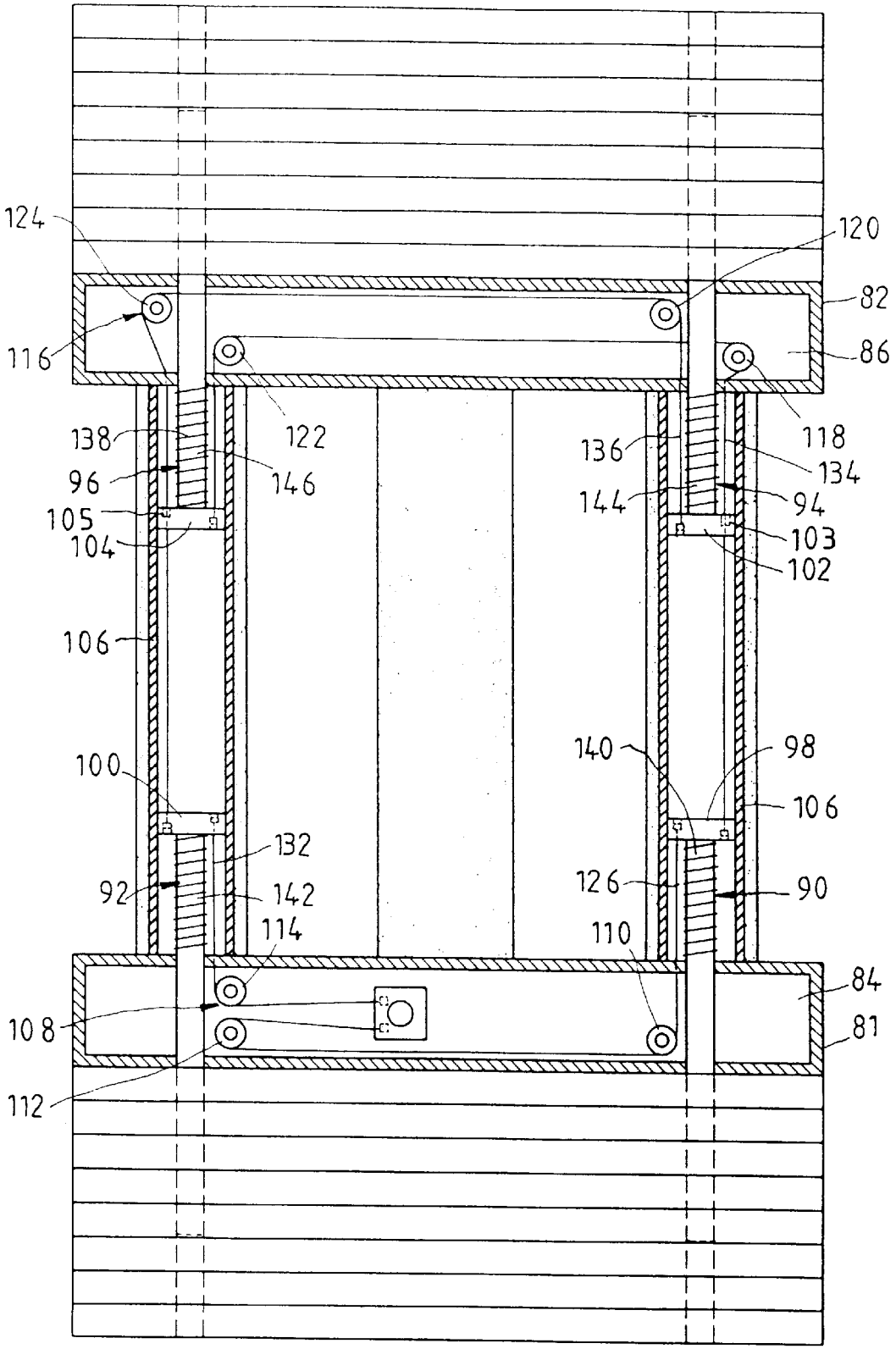
FIG. 6 shows a partial sectional view of a second preferred embodiment of the present invention.
Figure 7:
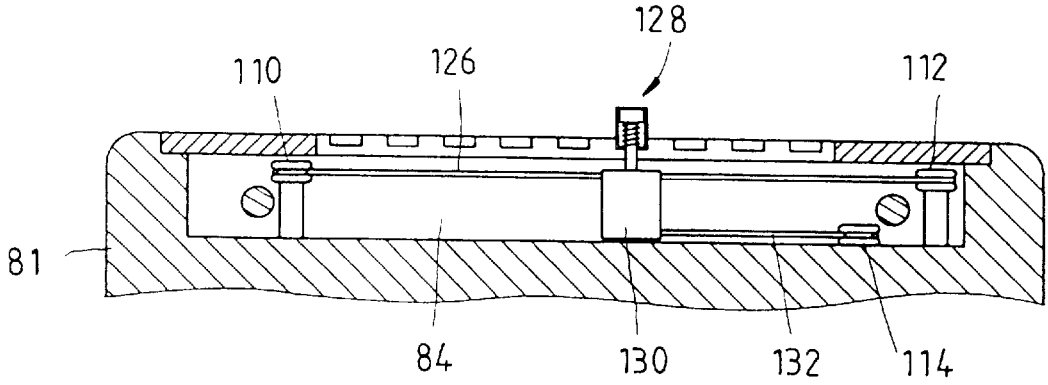
FIG. 7 shows a schematic view of a first receiving cell of the second preferred embodiment of the present invention.
Figure 8:
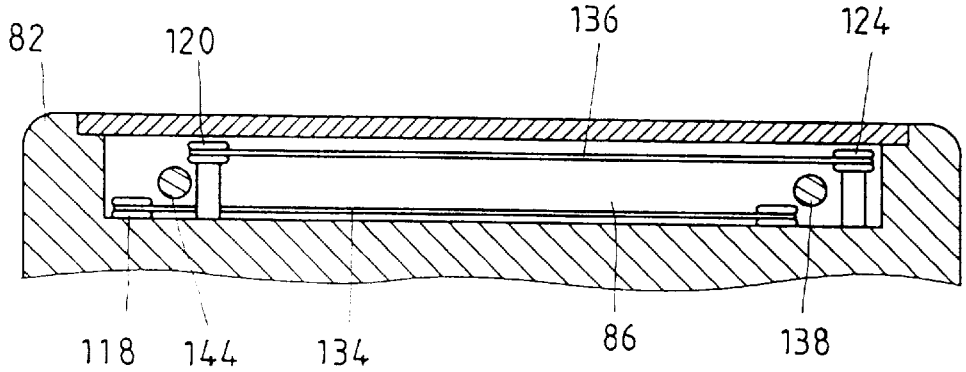
FIG. 8 shows a schematic view of a second receiving cell of the second preferred embodiment of the present invention.

As shown in FIGS. 6–8, a dumbbell of the second preferred embodiment of the present invention is basically similar in construction to the dumbbell 10 of the first preferred embodiment described above, except that the former has two plates 81 and 82, which are provided respectively with a first receiving cell 84, a second receiving cell 86, and that the former has a selection device which is provided with four pins 90, 92, 94, and 96. These four pins 90, 92, 94 and 96 are grouped in pair such that their heads 98, 100, 102, and 104 are oppositely disposed in the two hollow rods 106. In addition, the dumbbell of the second preferred embodiment of the present invention comprises a first steering mechanism 108 and a second steering mechanism 116. The first steering mechanism 108 is disposed in the first receiving cell 84 and is provided with three rotary wheels 110, 112 and 114. The second steering mechanism 116 is disposed in the second receiving cell 86 and is provided with four rotary wheels 118, 120, 122 and 124. Moreover, the right end of the base 130 of the adjustor 128 is fastened with one end of a first cord 126 whose other end is fastened with the head 98 of the first pin 90 via the rotary wheels 112 and 110. A second cord 132 is fastened at one end thereof with the right end of the base 130 such that other end of the second cord 132 is fastened with the head 100 of the second pin 92 via the rotary wheel 114. A third cord 134 is fastened at one end thereof with the head 98 of the first pin 90 via a hole 103 of the head 102 of the third pin 94 such that the third cord 134 is fastened at other end thereof with the head 104 of the fourth pin 96 via the rotary wheels 118 and 122. A fourth cord 136 is fastened at one end thereof with the head 102 of the third pin 94, and at other end thereof with the head 100 of the second pin 92 via the rotary wheels 120 and 124, and a hole 105 of the head 104 of the fourth pin 96. The dumbbell 80 of the second preferred embodiment of the present invention further comprises four elastic members 138, which are respectively fitted over the shanks 140, 142, 144, and 146 of the pins 90, 92, 94, and 96 such that the elastic members 138 are respectively located between the heads 98, 100, 102, 104, and the plates 81, 82.

The dumbbell 80 is similar in operation to the dumbbell 10, with the difference being that the four pins 90, 92, 94, and 96 are moved at the same time at a time when the adjustor 128 is displaced. When the adjustor 128 is moved leftwards, the first and the second cords 126 and 132 are loosened, thereby causing the first and the second pins 90 and 92 to be forced by the elastic force of the elastic members 138 to retract into the hollow rods 106. As a result, the third and the fourth cords 134 and 136 are loosened simultaneously so as to cause the third and the fourth pins 94 and 96 to be forced by the elastic force of the elastic members 138 to retract into the hollow rods 106. The four pins 90, 92, 94, and 96 can be thus extracted or retracted at the same time.

What is claimed is:

1. A dumbbell comprising:

a carrying seat formed of two plates parallel to each other, two hollow rods, and a grip;

each of said plates provided with at least one through hole corresponding in location to one of said hollow rods, and a plurality of carrying grooves, one of said plates provided with a receiving cell;

a plurality of weights with each of said weights formed of a pair of block bodies identical to each other and having a plurality of through holes corresponding in location to said through holes of said plates, and a plurality of carrying grooves;

each said pair of block bodies provided with two connection rods disposed therebetween, said connection rods being different in length between different pairs of block bodies so as to enable said weights to be juxtaposed on said carrying seat, and to enable each said connection rod to press against respectively one of said carrying grooves; and a selection device disposed in said receiving cell and composed of an adjustor, at least one cord, at least one steering mechanism, and at least two pins disposed in said hollow rods such that each said pin is connected at one end thereof with the adjustor, and the other end of said pins correspond to said through holes of said plates, and that said pins are simultaneously extracted from or retracted into said hollow rods when said adjustor is adjusted in position thereof, thereby resulting in said pins extending into said through holes of said block bodies of selected said weights.

2. The dumbbell as defined in claim 1 further comprising two support rods between said two plates.

3. The dumbbell as defined in claim 1, wherein said plate is provided with an open guide slot in communication with said receiving cell, said guide slot provided with a plurality of carrying cavities; and wherein said adjustor is moved along the direction of a longitudinal axis of said guide slot such that said adjustor can be located at any one of said carrying cavities.

4. The dumbbell as defined in claim 3, wherein said adjustor has a base disposed in said receiving cell, and a control end disposed on said base such that said control end is exposed from said guide slot to be retained in any one of said carrying cavities.

5. The dumbbell as defined in claim 1, wherein each of said pins has a shank and a head located at one end of said shank, said head having an outer diameter greater than an inner diameter of said through holes of said plates.

6. The dumbbell as defined in claim 5, wherein said selection device comprises two pins, two cords, and two elastic members, said pins being disposed in said hollow rods in an opposite manner such that said heads of said pins are fastened respectively with one end of said cords which are in turn fastened respectively at the other end thereof with said adjustor, said two elastic members being located between said heads and said plates.

7. The dumbbell as defined in claim 5, wherein each of said two plates is provided with a receiving cell; wherein said selection device comprises four pins, four cords and four elastic members, with said four pins being disposed in pairs in said two hollow rods such that heads of said first pin and said second pin are opposite in location to each other, and that heads of said third pin and said fourth pin are opposite in location to each other, and further that said heads of said first pin and said third pin are fastened with a first set of said cords, and further that said heads of said first pin, said fourth pin, said third pin and said second pin are fastened with a second set of said cords via said receiving cell of one of said two plates, said four elastic members being located between said four pins and said plates to enable said pins to be biased into said hollow rods at the time when said pins are not exerted on by an external force.

8. The dumbbell as defined in claim 7 further comprising two steering mechanisms, each disposed in one of said receiving cells of said two plates to facilitate the moving of said cords in said receiving cells.

9. The dumbbell as defined in claim 7 wherein said heads of said second pin and said fourth pin are each provided with a through hole; and wherein said second set of said cords passes through said through holes of said heads of said second pin and said fourth pin.

* * * * *